US006599110B2

(12) United States Patent
Gennami et al.

(10) Patent No.: US 6,599,110 B2
(45) Date of Patent: Jul. 29, 2003

(54) SCROLL-TYPE COMPRESSOR WITH LUBRICANT PROVISION

(75) Inventors: Hiroyuki Gennami, Kariya (JP); Kazuhiro Kuroki, Kariya (JP); Satoru Egawa, Kariya (JP); Yoshikazu Fukutani, Kariya (JP); Ken Suitou, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/106,689

(22) Filed: Mar. 25, 2002

(65) Prior Publication Data

US 2002/0136654 A1 Sep. 26, 2002

(30) Foreign Application Priority Data

Mar. 26, 2001 (JP) ..... 2001-088167

(51) Int. Cl.[7] ..... F01C 1/02

(52) U.S. Cl. ..... 418/55.6; 418/55.4; 418/1; 418/DIG. 1; 418/91; 418/100

(58) Field of Search ..... 418/55.6, 55.4, 418/1, DIG. 1, 91, 100

(56) References Cited

U.S. PATENT DOCUMENTS 4,568,256 A * 2/1986 Blain ..... 418/55.6
5,249,941 A * 10/1993 Shibamoto ..... 418/55.6
6,318,982 B1 * 11/2001 Fujii et al. ..... 418/55.6

FOREIGN PATENT DOCUMENTS

DE 19620477 A1 * 11/1997 ..... F04C/18/04
JP 58-117380 7/1983 ..... F04C/18/02
JP 02049990 A * 2/1990 ..... F04C/18/02

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A scroll-type compressor having a stationary scroll and a movable scroll is provided. A compression chamber is defined between a stationary scroll and a movable scroll. A refrigerant introducing passage formed in the movable scroll for introducing a refrigerant from the compression chamber to a driving mechanism. The compressed refrigerant including a lubricant introduced through the passage is affective to lubricate the driving mechanism. The compressor may also include a sump to collect the lubricant leaving the driving mechanism. Collected lubricant is reintroduced into the compression region via a suction region of the compressor.

20 Claims, 6 Drawing Sheets

SCROLL-TYPE COMPRESSOR WITH LUBRICANT PROVISION

BACK GROUND OF THE INVENTION

The present invention relates to a scroll-type compressor having movable and stationary scrolls and, in particular, to an improved lubrication arrangement and method for lubricating the components of a scroll-type compressor.

One type of scroll-type compressor to, which the present invention is applicable, has a compressed gas discharge port in the stationary scroll. Unexamined Japanese Patent Application No. 58-117380 discloses this type of compressor. The lubrication system of that compressor employs an oil sump at the bottom of a housing that accommodates an electric motor for driving the movable scroll. Oil in the oil sump is pumped by an oil pump through an oil passage that is eccentrically formed in the motor shaft (drive shaft of the movable scroll). The oil passage introduces the oil into a bearing located between the motor shaft and the movable scroll. Then, the oil in the bearing is radially introduced from the bearing to a thrust support member, which rotatably supports the movable scroll, and lubricates the support member. Finally, the oil is collected by a recovery hole and falls to the oil sump by gravity.

According to above application, it is necessary to install an oil pump in order to ensure a sufficient supply of oil to the sliding surfaces of the bearing. The requirement for an oil pump increases the cost of the compressor and introduces another component that may constitute a failure point. It therefore is desirable to achieve lubrication of the compressor without incorporating separate oil pump.

SUMMARY OF THE INVENTION

One object of the present invention, therefore, is to provide a scroll-type compressor and a method for lubricating the same, which obviates the need for an oil pump. Another object of the invention is to lubrication of a scroll compressor by introducing a refrigerant including a lubricant into the components to be lubricated through a pressure difference that exists between two or more regions of the compressor.

To achieve the foregoing, the present invention incorporates introducing passages for introducing lubricant-containing refrigerant from a compression chamber of a scroll-type compressor to a lower pressure region where the lubricant can lubricate components of the drive mechanism. At least part of the introducing passage is effective to restrict the rate of flow of refrigerant. The introducing passage may be located in the spiral wall of the movable scroll, or may be located in the movable scroll base plate. The preferred embodiment also includes a lubricant sump for collecting used lubricant in a lower pressure region of the compressor for re-introduction into a suction zone of the compressor via a lubricant passage interconnecting these two zones.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of a motor driven scroll-type compressor (hereinafter, compressor) incorporating the improved lubricating method of the present invention is shown in FIGS. 1 to 4. The compressor is typically employed to compress a refrigerant gas.

Figure 1:
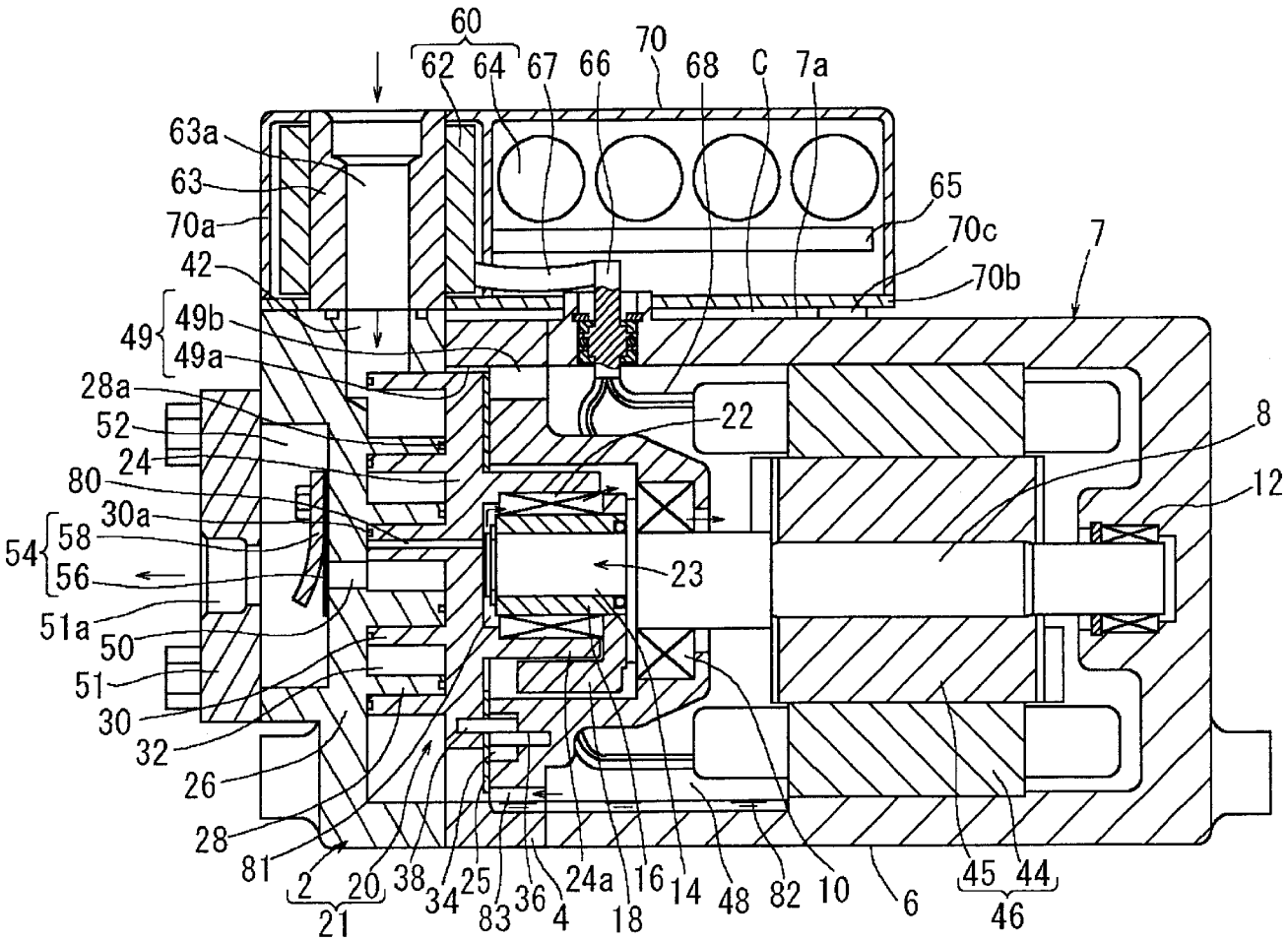
FIG. 1 is a cross-sectional view of a scroll-type compressor according to a first embodiment of the present invention.

Referring to FIG. 1, an end surface of a stationary scroll 2 is jointed to an end surface of a center housing 4. The opposite end of the center housing 4 is connected to a motor housing 6. The stationary scroll 2, the center housing 4 and the motor housing 6 comprise a compressor body 7. A drive shaft 8 is rotatably supported by the center housing 4 and motor housing 6 through radial bearings 10,12. An eccentric shaft 14 is integrally formed with the end of the drive shaft 8.

A bushing 16 is fitted on the eccentric shaft 14 to rotate therewith integrally. A balance weight 18 is fitted on the end of the bushing 16 so that the balance weight 18 integrally rotates with the bushing 16. A movable scroll 20 is mounted on the bushing 16 through a needle bearing 22 so that the movable scroll 20 faces the stationary scroll 2. A cylindrical boss 24*a* extends toward the rear (right hand side in FIG. 1) of a movable scroll base plate 24, and accommodates the needle bearing 22. It will be seen that rotation of the motor shaft 8 causes the eccentric shaft 14 to trace an orbital motion that is transmitted to the movable scroll 20 in a conventional manner.

Figure 2:
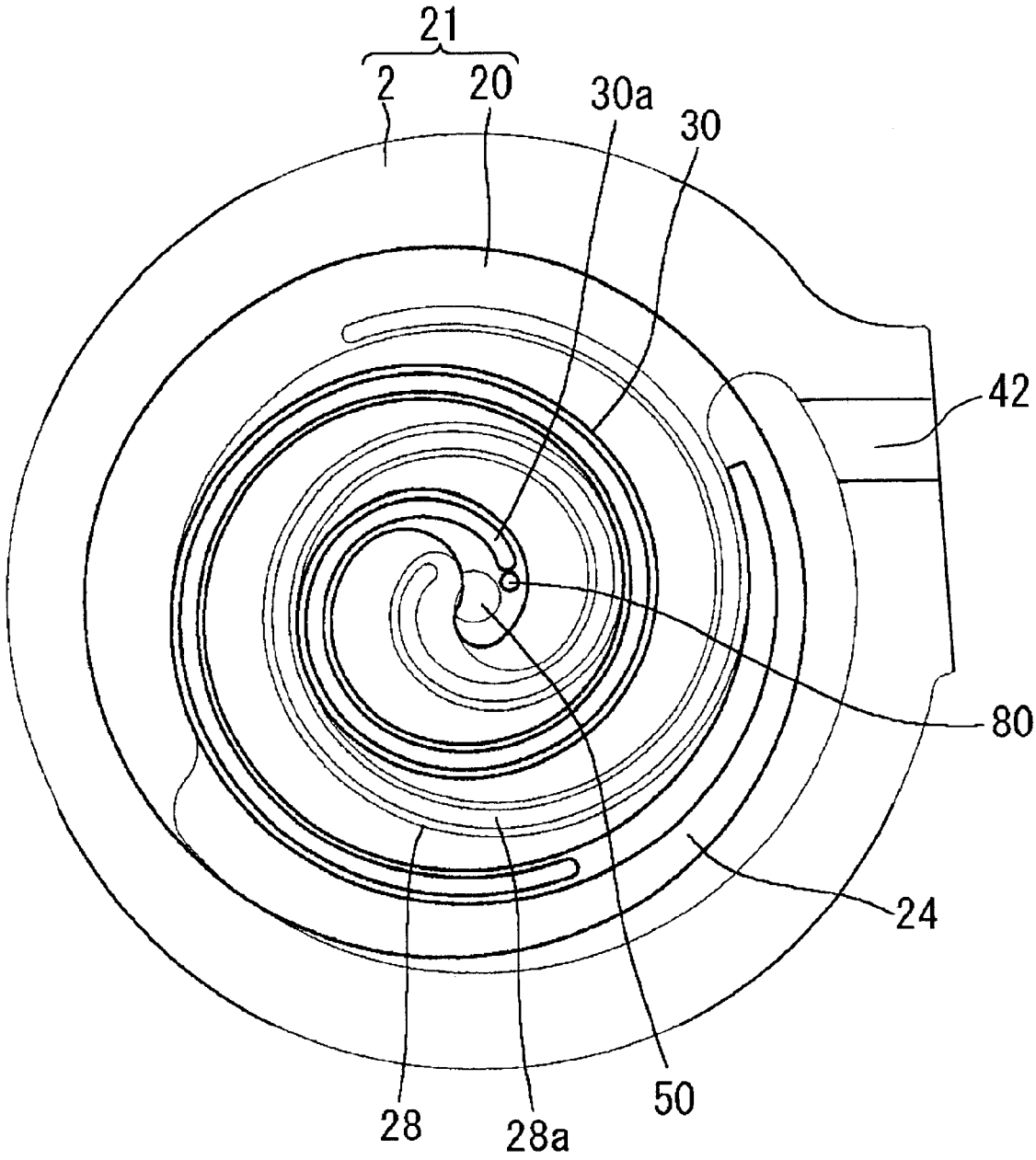
FIG. 2 is a perspective view of the stationary scroll and movable scroll, with the outline of the stationary scroll shown with fine lines, and the outline of the movable scroll shown with bold lines.

The stationary scroll 2 includes a stationary spiral wall 28 formed on one side of a stationary scroll base plate 26. Similarly, the movable scroll 20 has a movable spiral wall 30 formed on one side of a movable scroll base plate 24. The stationary scroll 2 and the movable scroll 20 are arranged so that the stationary spiral wall 28 and the movable spiral wall 30 are engaged each other. A tip seal 28*a* is fitted on the end surface of the stationary spiral wall 28, while a tip seal 30*a* is fitted on the end surface of the movable spiral wall 30. As shown in FIG. 2, crescent-shaped compression chambers (closed spaces) 32 are formed between the stationary spiral wall 28 and the movable spiral wall 30. These two walls contact each other along lines that move from the outer periphery to the inner part of the stationary spiral wall as the movable scroll follows an orbital motion during operation of the motor. As noted above, the orbital movement of the eccentric shaft 14 brings the orbital motion of the movable scroll 20. The balance weight 18 cancels the centrifugal force caused by the orbital motion of the movable scroll 20.

A driving mechanism 23, which transmits rotating force of the drive shaft 8 to the movable scroll 20 as the orbital motion, comprises the eccentric shaft 14, the bushing 16, the needle bearing 22 and the radial bearings 10, 12.

As shown in FIG. 1, plural equidistant holes 34 (e.g. four holes) are located in the forward end of the center housing 4 about its periphery. (Only one hole 34 is visible in FIG. 1). Stationary pins 36 of smaller diameter are supported in the center housing 4 and extend into the holes 34. Similarly, pins 38 fixed on the movable scroll base plate 24 also extend into the holes 34, but from the opposite direction. While the eccentric shaft 14 rotates, the movable scroll 20 tends to rotate about the axis of the bushing 16. The pins 36 and 38 prevent the movable scroll 20 from self-rotating during rotation of the eccentric shaft 14. Thus, the holes 34 and pins 36 and 38 constitute a rotation preventing mechanism for restricting rotation of the orbiting movable scroll 20 during operation of the compressor.

A thrust plate 25 is fixed to the movable scroll 24, and interposed between the rear of the movable scroll base plate 24 and the opposed forward end surface of the center housing 4. The thrust plate 25 maintains the appropriate clearance between the scroll base plates 24, 26 and spiral walls 28, 30. The movable spiral wall 30 is sealed against the top surface of the stationary scroll base plate 26 through the tip seal 30*a*, which resides in a groove in end surface of the movable spiral wall 30. The contact pressure of the movable spiral wall 30 is adjusted by the thickness of above-mentioned thrust plate 25.

The compressor is driven by an electric motor 46, of which the motor stator 44 is secured in a closed motor chamber 48 of the motor housing 6, the motor rotor 45 being fixed on the drive shaft 8.

As earlier noted, rotation of the shaft 8 results the rotation of the eccentric shaft 14, which translates into the orbital motion of the movable scroll 20. The gas to be compressed, a refrigerant, for example, enters at an inlet 42 formed in the stationary scroll 2 and flows from the periphery of the scrolls 2, 20 into a recess defined between the base plates 24, 26 and spiral walls 28, 30. Then, the orbital motion of the movable scroll 20 seals the spiral walls 28, 30 so as to form into compression chambers 32 to compress the refrigerant. The compression chambers 32 move progressively inwardly toward the center of the scrolls 2, 20, thereby progressively reducing the volume of the gas trapped therein and effecting a consequent compression of the gas.

A discharge port 50 formed at the center portion of the stationary scroll base plate 26 communicates with the compression chamber 32 at the center of the scroll. A discharge chamber 52 is formed on the rear of the stationary scroll base plate 26, and a discharge valve 54 for opening and closing the discharge port 50 is disposed in the discharge chamber 52. The discharge valve 54 comprises a reed valve 56 and a retainer 58. An outlet 51*a* in the rear cover 51 of the discharge chamber 52 will be connected to an external refrigerant discharge conduit (not shown in the drawings).

A compression mechanism 21, which includes the scrolls 2, 20, and the motor chamber 48 are partitioned by the center housing 4. A communication passage 49 in the center housing 4 connects a suction region in the refrigerant flow with the motor chamber 48. To that end, the inlet 42 is connected with a space 49*a* around the periphery of the movable scroll 20, which in turn communicates with the motor chamber 48 through a communication hole 49*b* in the center housing 4. The space 49*a* and the communication hole 49*b* together constitute the communication passage 49, which remain open regardless the orbital position of the movable scroll 20.

A flat mounting surface 7*a* is formed on the outer peripheral surface of the compressor body 7 for mounting an inverter housing 70. Control elements, including an inverter 60 for controlling the electric motor 46 is contained within the housing 70. High temperature elements of the inverter 60, such as switching devices 62 are separated from low temperature parts such as capacitors 64. The switching devices 62 are located in a cylindrical portion 70*a* of the housing 70, and supported by an outer surface of a cylindrical body 63 in the cylindrical portion 70*a*.

The cylindrical body 63 has an inlet passage 63*a* that connects to the inlet 42, and further the passage 63*a* will be connected to an external refrigerant suction conduit (not shown in the drawings). Preferably the inverter housing 70 is made of heat insulating material, such as synthetic resin. The bottom plate 70*b* of the inverter housing 70 is mounted on the flat mounting surface 7*a* through a leg portion 70*c* with a clearance C, which functions as a heat insulating area.

Electrical power for the motor is supplied from the switching devices 62, which are connected to the electric motor 46 via lead wires 67, 68 through three conducting pins 66 that extend through the walls of the motor housing 6 and the inverter housing 70.

In accordance with the invention, and as shown in FIGS. 1 and 2, a refrigerant introducing passage 80 extends through the movable spiral wall 30 and the movable scroll base plate 24. During operation of the compressor, it introduces a small amount of compressed refrigerant from the innermost compression chamber 32 into a space 81 formed generally at the rear of the movable scroll base plate 24 in the vicinity of the boss 24*a*. The introducing passage 80, which is bored through the movable spiral wall 30, has one opening end in the end surface of the movable spiral wall 30 and the other opening end in the rear surface of the scroll base plate 24 to connect to the space 81.

Figure 4:
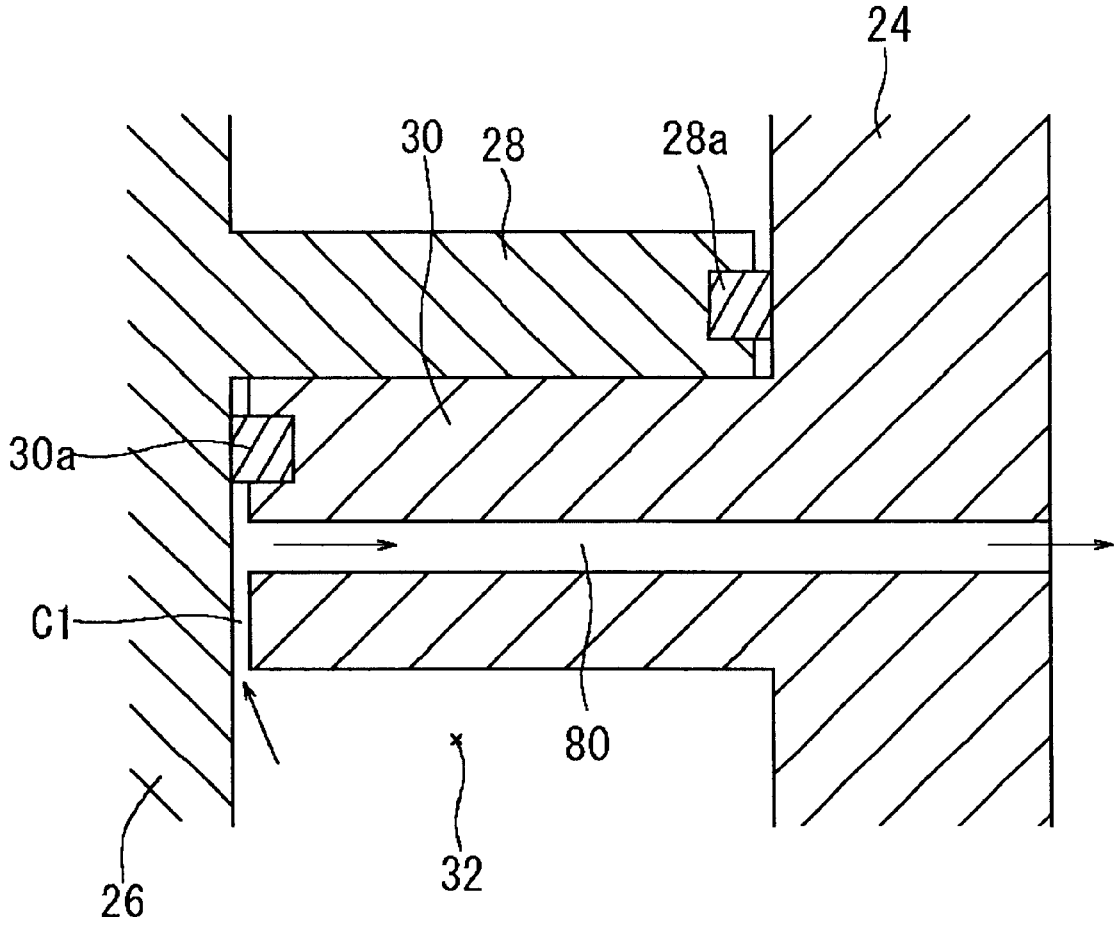
FIG. 4 is an enlarged cross-sectional view of a central portion of the stationary and movable scrolls of the compressor.

As best seen in FIG. 4, the tip seal 30*a* protrudes slightly beyond the end of the movable spiral wall 30. Accordingly, an clearance C1 is established between the end surface of the movable spiral wall 30 where the tip seal 30*a* does not exist and the surface of the stationary scroll base plate 26.

Accordingly, the refrigerant introducing passage 80 includes the clearance C1 and always communicates with the compression chamber 32 to enable compressed refrigerant to flow into the space 81. The clearance C1 principally restricts the flow-rate of the introduced refrigerant from the compression chamber 32 to the space 81.

The thrust plate 25 adjusts the contact pressure of the movable spiral wall 30 through the tip seal 30*a*.

Figure 3:
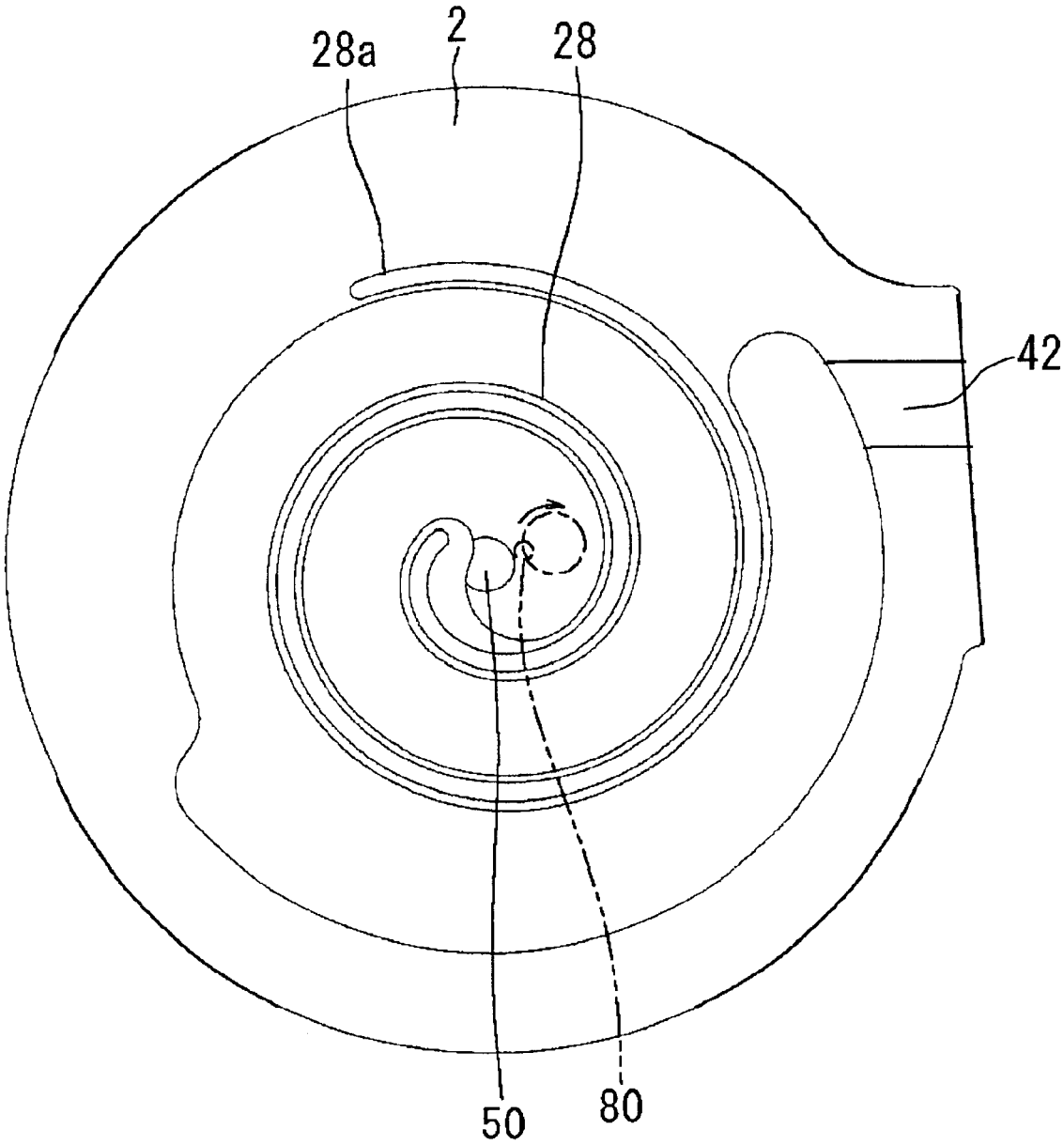
FIG. 3 is an end view of the stationary scroll, illustrating a orbital locus of a communicating hole through the movable scroll for introducing a refrigerant gas.

The refrigerant introducing passage 80 orbits with the movable scroll 20, its orbital locus shown in FIG. 3 by the phantom circular line. It will also be noted from FIG. 3 that the passage 80 is positioned so as not to communicate with the discharge port 50. Accordingly, high-pressure refrigerant in the discharge chamber 52 cannot flow directly into the space 81 through the refrigerant introducing passage 80.

An oil sump 82 is formed at the bottom of the motor chamber 48. The oil sump 82 connects to a suction region (a space between the outer periphery of the spiral walls 28, 30) through an oil passage 83.

In operation of the compressor, it will be understood that refrigerant introduced into the inlet 42 is compressed in the compression chamber 32, and the high-pressure gas is discharged through the discharge valve 54 into the discharge chamber 52. Referring to FIG. 4, the refrigerant in the innermost compression chamber 32 flows into the space 81 through the clearance C1 and the refrigerant introducing passage 80 as a result of the differential pressure between the low pressure in the space 81 and high pressure in the compression chamber 32.

Referring to FIG. 1, the refrigerant with entrained oil introduced into the space 81 flows into the motor chamber 48 through the spaces between the sliding surfaces of the elements of the orbital driving mechanism 23, such as the needle bearing 22 and radial bearing 10, so that the oil lubricates those surfaces. In this embodiment, the opening of the refrigerant introducing passage 80 in the moveable scroll base plate 24 may be located, formed or angled in a particular manner to supply oil directly to the necessary parts for lubrication, such as the needle bearing 22.

The entrained oil in the refrigerant blown into the space 81 separates from the refrigerant and descends to the oil sump 82 at the bottom of the motor chamber 48. Because the suction region at the periphery of the spiral walls 28 and 30 is at a lower pressure than the motor chamber 48, oil stored in the oil sump 82 flows into the suction region through the oil passage 83 and there joins with the refrigerant and transported into compression chamber 32. As earlier stated, some of the compressed refrigerant in the innermost compression chamber 32 is forced through the passage 80 into the space 81 as a result of the differential pressure. Since oil is contained in the flow through the passage, this oil lubricates the needle bearing 22 and the radial bearing 10 of the driving mechanism 23. By utilizing the differential pressure to supply lubricating oil, the compressor lubrication system can be simplified driven pumps are no longer essential. The clearance C1 between the stationary scroll base plate 26 and the movable spiral wall 30 is preferably selected to restrict the rate of refrigerant flow to the minimum necessary to achieve sufficient lubrication of the bearings so as to prevent decreasing efficiency due to the outflow of the refrigerant from the compression chamber 32.

It may be mentioned that, when the refrigerant enters the passage 63*a* of the cylindrical body 63 in the inverter housing 70 from an evaporator in the external conduit (not shown in the drawings) to the compressor, the refrigerant cools the inverter 60 in the inverter housing 70, especially the switching devices 62 adjacent to the cylindrical body 63.

Additionally, during the operation of the compressor, both the compression process and the electric motor 46 generate heat in the compressor body 7. For that reason, the inverter housing 70 accommodating the inverter 60 is spaced from the compressor body 7 with the clearance C in order to improve thermal isolation of the housing 70 from the compressor body 7 both during the operation and stop of the compressor.

During the operation of the compressor, the motor chamber 48 is always connected to the suction region of the refrigerant through the communication passage 49, as well as through the oil passage 83 at a bottom of the center housing 4. The heat is transmitted between the refrigerant in the suction region and the refrigerant in the motor chamber 48 through the passages 49,83, that is high heat in the refrigerant in the motor chamber 48 is transmitted to the refrigerant in the suction region, and the heat transmission cools the electric motor 46. Additionally, the refrigerant flows between the motor chamber 48 and the suction region through the communication passage 49 and the oil passage 83, since the pressure in the motor chamber 48 is higher than the suction region. Therefore, heat is transmitted from the motor chamber 48 to the suction region through the communication passage 49 or the oil passage 83 with the refrigerant. Accordingly, the refrigerant flow contributes to electric motor 46 cooling.

Above-mentioned cooling effects are so called "stagnation cooling" that involves a little refrigerant. This is different from the conventional designs wherein the entire motor chamber may serve as a refrigerant passage where a large amount of refrigerant flows. Because only a small amount of the refrigerant in the suction region contributes to the "stagnation cooling", the temperature rise in the suction refrigerant is limited. Accordingly, the temperature limitation prevents the specific volume of the suction refrigerant being increased so as to solve the problem of less compression efficiency.

It may also be noted that the thermal load of the inverter 60 is generally much less than that of the electric motor 46. Therefore, the thermal energy extracted from the inverter 60 by the refrigerant affects only a slight rise of the refrigerant temperature, as compared with cooling systems in which the entire refrigerant traverses the motor chamber 48. Therefore, arrangement of the present invention does not have less compression efficiency.

The illustrated embodiment gains high cooling efficiency because the suction refrigerant for cooling the electric motor 46 is at a lower temperature than that of the discharge refrigerant. Additionally, sealing material around the drive shaft 8 to seal the motor chamber 48 can be omitted, since some refrigerant flow from the discharge region into the motor chamber 48 is utilized for lubrication and therefore not a disadvantage. The invention therefore has simple structure and reduces the manufacturing cost.

The second embodiment will be now described with reference to FIG. 5. In this embodiment, the needle bearing 22 between the bushing 16 and the boss 24*a* of the movable scroll base plate 24 is replaced by a plain bearing 27 (sliding bearing), in order to have the sealing function of the plain bearing 27. The other members of this embodiment that are similar to the first embodiment have same reference numbers.

The plain cylindrical bearing 27 is press-fitted into the inner cavity of the boss 24*a,* and rotatably receives the bushing 16. The clearance between the sliding surface of the plane bearing 27 and the bushing 16 is sufficiently close to perform a sealing effect. The sealing performance depends on the axial length of the plain bearing 27. The longer the axial length, the better the sealing efficiency. In this embodiment, the plain bearing 27 extends the axial length of the sliding surface of the eccentric shaft 14. During the operation of the compressor, the refrigerant entering the space 81 from the compression chamber 32 flows to the radial bearing 10 through the clearance of the sliding surface of the plain bearing 27 in order to lubricate the sliding surface with the oil in the refrigerant. The oil film formed on the sliding surfaces prevents the leakage of the refrigerant into the motor chamber 48. Consequently, the refrigerant in the space 81 will be in a high-pressure state that is close to the pressure in the compression chamber 32.

Figure 5:
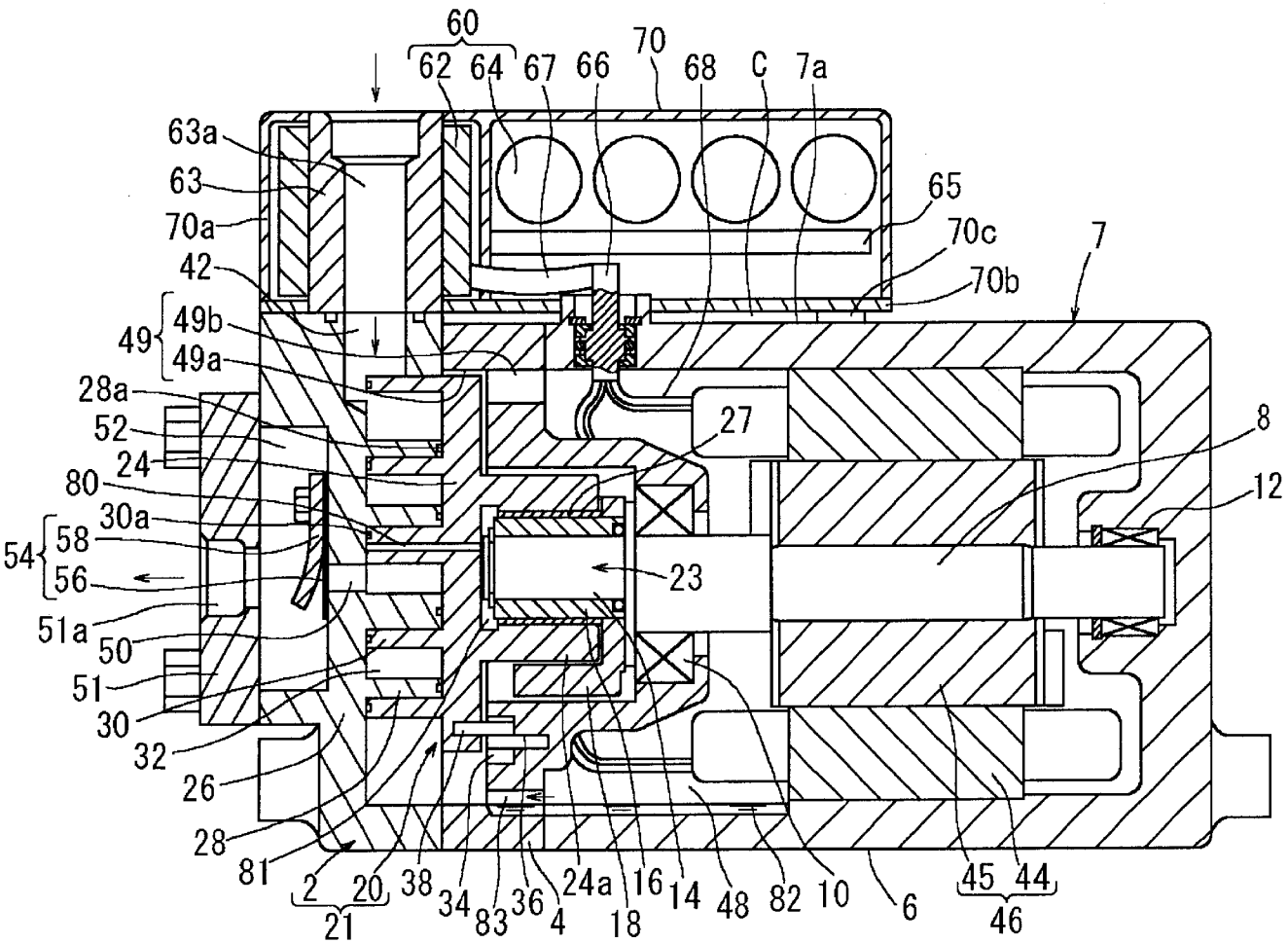
FIG. 5 is a cross-sectional view of a second embodiment of a scroll-type compressor according to the present invention.

One benefit of the embodiment of FIG. 5 is that the high pressure (backpressure) in the space 81 applies a force to rear of the movable scroll base plate 24 in the axial direction toward the stationary scroll 2. This improves the sealing performance at the tip seals 28*a* and 30*a*. Furthermore, due to this backpressure against the movable scroll 20, a thrust plate for adjusting the clearance such as illustrated in the first embodiment can, in many instances, be eliminated.

Figure 6:
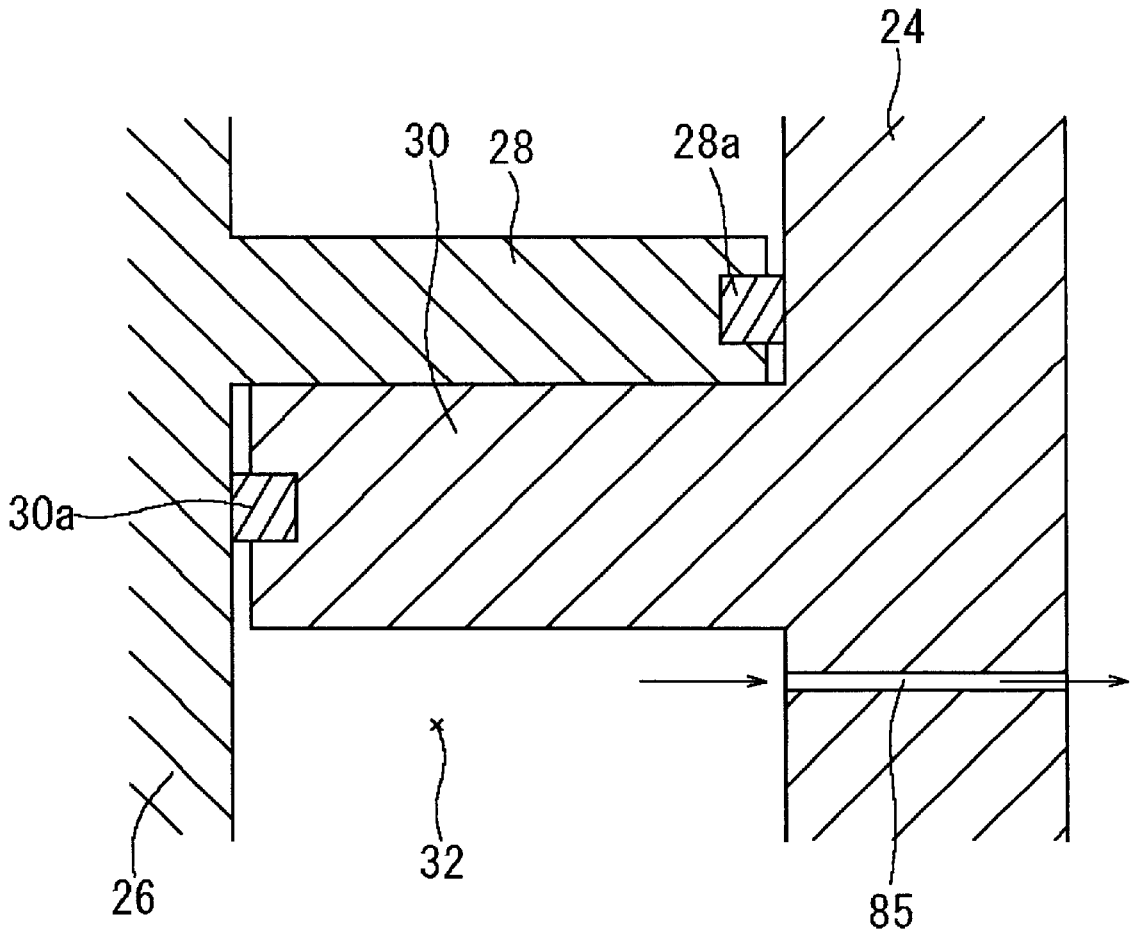
FIG. 6 is an enlarged partial sectional view of a central portion of the stationary and movable scrolls of a third embodiment of the present invention.

A third embodiment will be now described with reference to FIG. 6. This embodiment has a narrow passage 85 with small diameter hole (pinhole), through the movable scroll base plate 24. The diameter of the narrow passage 85 is determined to obtain a necessary and sufficient flow of the refrigerant from the compressor chamber 32 into the space 81 to lubricate the driving mechanism 23. The narrow passage 85 itself therefore serves as the restriction passage in this embodiment.

In the above-described embodiments, the refrigerant introducing passage 80 and narrow passage 85 are formed in the movable spiral wall 30 or base plate 24, respectively. However, provision of the restricting passage is not limited to any specific locations within the movable scroll 20 or base plate 24, but it may be determined based on the efficiency regarding the outflow of the refrigerant. Moreover, although the scroll-type compressor has been disclosed as driven by an electric motor, the invention is not limited to an electric motor as the driving force, but can be adapted to other power sources such as an engine or other mechanical power source.

Therefore, the present examples and embodiments are to be considered as illustrative and not restrictive and the invention is not to be limited to the details given herein, but may be modified within the scope of the appended claims.

What is claimed is:

1. A scroll-type compressor comprising:

a stationary scroll and a movable scroll, the movable scroll and stationary scroll defining at least one compression chamber therebetween, wherein the compression chamber compresses a refrigerant gas that includes a lubricant;

a driving mechanism for orbiting the movable scroll, the driving mechanism disposed in a lower pressure region; and an introducing passage formed at least in part through the movable scroll and intercommunicating the compression chamber with the lower pressure region so as to allow some of the refrigerant in the compression chamber to flow into the lower pressure region to lubricate the driving mechanism by the lubricant contained in the refrigerant, and at least part of the introducing passage effective to restrict the rate of flow of refrigerant therethrough.

2. The scroll-type compressor according to claim 1, wherein the movable scroll includes a spiral wall and the introducing passage is formed in the spiral wall.

3. The scroll-type compressor according to claim 2, further comprising a tip seal fitted on and protruding from the end surface of the spiral wall of the movable scroll, wherein at least said part of the introducing passage is defined between the end surface of the spiral wall and the stationary scroll at a location displaced from the tip seal.

4. The scroll-type compressor according to claim 2, wherein the movable scroll has a base plate supporting said spiral wall, and the introducing passage including an opening through the spiral wall and base plate.

5. The scroll-type compressor according to claim 1, wherein the movable scroll has a base plate, and the introducing passage including an opening through the base plate.

6. The scroll-type compressor according to claim 1, further comprising an eccentric drive shaft for driving the movable scroll with an orbital motion, a boss at the rear of the movable scroll, and a bearing disposed between the boss and the drive shaft, wherein the refrigerant is introduced into a space surrounded by the boss.

7. The scroll-type compressor according to claim 6, wherein the refrigerant flows from the space to the sliding surface of the bearing for lubrication.

8. The scroll-type compressor according to claim 6, wherein the space has high pressure by the introduced refrigerant from the compression chamber, wherein the pressure presses the movable scroll base plate toward the stationary scroll side.

9. The scroll-type compressor according to claim 8, wherein the bearing is a plain bearing that has sliding surfaces sufficiently closed each other in order to perform a sealing effect therebetween.

10. The scroll-type compressor according to claim 8, wherein the bearing is a plain bearing that forms lubricant films on the sliding surfaces in order to perform a sealing effect therebetween.

11. The scroll-type compressor according to claim 1, further comprising a housing having a motor chamber accommodating an electric motor as a power source and communicating with the lower pressure region.

12. The scroll-type compressor according to claim 11, further comprising a lubricant sump in the motor chamber so as to collect the lubric ant that is separated from the refrigerant.

13. The scroll-type compressor according to claim 12, further comprising a lubricant passage for introducing lubricant from the sump into a suction region of the compressor.

14. The scroll-type compressor according to claim 13, further comprising a communication passage to communicate a suction region of the compressor with the motor chamber.

15. The scroll-type compressor according to claim 1, the introducing passage including a narrow passage so as to restrict the refrigerant flow by the cross-section of the narrow passage.

16. The scroll-type compressor according to claim 15, wherein the movable scroll includes a spiral wall and the narrow passage is formed in the spiral wall.

17. The scroll-type compressor according to claim 15, wherein the movable scroll has a base plate supporting said spiral wall, and the introducing passage including an opening through the spiral wall and base plate.

18. The scroll-type compressor according to claim 15, wherein the movable scroll has a base plate, and the introducing passage including an opening through the base plate.

19. A method for lubricating a scroll-type compressor, the scroll-type compressor having a stationary scroll and a movable scroll, the movable scroll and stationary scroll defining at least one compression chamber therebetween, wherein the compression chamber compresses a refrigerant gas that includes a lubricant and a driving mechanism for orbiting the movable scroll, the driving mechanism disposed in a lower pressure region, the method comprising:

introducing step for introducing some of the compressed refrigerant in the compression chamber into the lower pressure region;

restricting step for restricting refrigerant flow into the lower pressure region; and lubricating step for lubricating the driving mechanism by the lubricant in the refrigerant.

20. The method for lubricating the scroll-type compressor according to claim 19, further comprising separating step for separating the lubricant from the refrigerant and collecting process for collecting the separated lubricant after lubrication.

* * * * *